US005176441A

United States Patent [19]

Horváth dr.née Végh et al.te of Patent:

[11] Patent Number: 5,176,441

Jan. 5, 1993

[54] LAMP WITH A REFLECTOR ENVELOPE

[75] Inventors: Gyözöné Horváth dr.née Végh; Zoltán Losonczi; György Szabo, all of Budapest, Hungary

[73] Assignee: Tungsram Reszvenytarsasag, Budapest, Hungary

[21] Appl. No.: 785,154

[22] Filed: Oct. 28, 1991

Related U.S. Application Data

[63] Continuation of Ser. No. 567,802, Aug. 15, 1990, abandoned.

[30] Foreign Application Priority Data

Sep. 22, 1989 [HU] Hungary ..... 4972/89

[51] Int. Cl.[5] ..... F21V 17/00

[52] U.S. Cl. ..... 362/267; 362/328; 362/455

[58] Field of Search ..... 362/263, 267, 374, 375, 362/306, 307, 310, 456, 457, 390, 243, 328, 440, 455

[56] References Cited

U.S. PATENT DOCUMENTS

| | | | |
|---|---|---|---|
| 1,610,105 | 12/1926 | Moire | 362/298 |
| 2,499,555 | 3/1950 | Wronkowski | 362/293 |
| 3,696,238 | 10/1972 | Stymenski | 362/293 |
| 4,410,931 | 10/1983 | De Candia et al. | 362/375 |
| 4,433,366 | 2/1984 | Wade | 362/267 |
| 4,609,977 | 9/1986 | Eckhardt et al. | 362/61 |
| 4,612,609 | 9/1986 | Collins | 362/267 |
| 4,797,790 | 11/1989 | Brodling et al. | 362/328 |
| 4,833,576 | 5/1989 | Mers et al. | 362/263 |

FOREIGN PATENT DOCUMENTS

| | | | |
|---|---|---|---|
| 0139075 | 5/1985 | European Pat. Off. | 362/267 |
| 2911229 | 10/1980 | Fed. Rep. of Germany | 362/306 |
| 89126319 | 12/1989 | Fed. Rep. of Germany . | |
| 817718 | 5/1937 | France | 362/374 |
| 1143132 | 6/1989 | Japan . | |
| 1209910 | 10/1970 | United Kingdom | 362/374 |
| 2034016 | 5/1980 | United Kingdom . | |

*Primary Examiner*—Richard R. Cole
*Attorney, Agent, or Firm*—Michael N. Meller

[57] ABSTRACT

In a lamp with a reflector envelope ensuring modified light output, comprising a conical reflecting body (2), an insert light source (4) arranged within the conical reflecting body (2) and a light transmitting front element (3) fixed to the conical reflecting body (2), there is between the conical reflecting body (2) and the front element (3) a clearance (10) determined by the dimensions and the inner spring force of a mechanical fixing body (5) connecting the conical reflecting body (2) and the front element (3), wherein at least a part of the clearance (10) is occupied by a deformable sealing material (6) or adhesive.

6 Claims, 1 Drawing Sheet

LAMP WITH A REFLECTOR ENVELOPE

This application is a continuation of application Ser. No. 567,802 filed Aug. 15, 1990, now abandoned.

FIELD OF THE INVENTION

The present invention relates to a lamp with a reflector envelope of modified light output. The lamp is made with a conical reflecting body in a given case covered by a thin dichroic or metallic layer, an insert lamp emitting light, preferably a halogen incandescent lamp and a front element fixed to the conical body in a mechanical way or by adhesion.

BACKGROUND OF THE INVENTION

The demand for lamps having a reflector envelope equipped with a halogen incandescent insert lamp of modified light is gradually increasing. They are very advantageous for illumination of objects arranged in a shop-window, but they are very often used for general lighting purposes owing to the fact that they provide concentrated illumination at low energy consumption.

Lamps having a reflector envelope first came into general use in open embodiments, i.e. they had no front element, as shown, for example, in U.S. Pat. Nos. 4,021,659, 4,169,237 and 4,169,238.

However, illuminating lamps having a closed reflector envelope are now in demand. In these lamps the conical reflecting body was united with a front element and so a closed envelope is formed. The front element is either simply a light transmitting plate matching the front surface of the conical element or an edge extending from the front surface the conical element, or it constitutes a special optical element modifying the light emitted by the insert lamp due its structure.

There is known a lamp wherein the conical body is united with the front element by mechanical means, for example, by the use of a metallic pressure ring having edges from two sides, as can be seen, for example, in the U.S. Pat. No. 4,213,170.

Further, there is known also a lamp, wherein the conical reflecting body is united with a front element by adhesive, as can be seen in German Laid-Open Appln. No. DE-2 228 684.

The known solutions prescribing uniting a conical reflecting body and a front element have not fulfilled the requirements as expected.

The rigid fixation made by adhesive is not durable enough, especially in the case of an insert light source consisting of a halogen incandescent lamp. For example, if the front element arranged in a recess made along the front surface of the conical reflecting body is fixed by an adhesive of high thermoresistivity, the recess made on the front surface of the conical reflecting body should be prepared so that the mantle surface of the front element matches the edge with a substantially small matching clearance. This is important because the conical reflecting body made of hard glass having a linear thermal expansion coefficient of about $36.10^{-6}$ cm/cm.°C. should be kept together with the front element of generally very different thermal expension coefficient by the adhesive applied. If the matching clearance between the outer mantle surface of the front element and the recess surrounding the edge of the conical reflecting body is greater than sometimes ten microns, the thermal expansion and contractions cause the adhesive bond to crack and gradually to decompose during the life of the lamp. The adhesive bond will slowly be lost and between the front element and the conical body a harmful resonance comes into being. If the lamp is applied upwardly or in a horizontal position it is a further problem that the cracked adhesive bond after a time cannot hold the front element, which falls out from the conical body.

If the fixation is realized only by mechanical means, it is not stable enough. An accidental vibration load can cause light movement of the front element and this has a harmful effect especially when the front element performs an optical function.

SUMMARY OF THE INVENTION

The present invention is intended to create a solution for avoiding the drawbacks shown above in the case of lamps equipped with a reflector envelope closed by a front element and to ensure the reliable assemblage of such lamps.

To avoid the drawbacks known from the state of the art, a lamp should be prepared wherein the mechanical fixing element can in an unambiguous way determine the position of the front element fixed on the front surface or edge of the conical reflecting body and the clearance formed therebetween. The shape and the elastic deformation of the fixing element can influence the dimension of the clearance in a codependent way. This codependency means that the two factors should be harmonized in order to give a satisfactory solution to the known problems discussed above. The clearance regulated to the required value should be filled at least partly with a deformable thermoresistent sealing material.

Hence, the invention is based on the recognition that the stability of the adhesive or sealing material introduced between the front surfaces of the conical reflecting body and the front element can be ensured if the dimension of the clearance is predetermined with high accuracy by an elastic fixing element which presses together the two elements to be assembled by means of a sealing material with predetermined force. In this way the thickness of the adhesive or rather sealing layer arranged between the parts can be regulated with high accuracy and a minimal amount of the material is sufficient for assemblage. As an elastic fixing element a disc can be applied which is equipped with ears surrounding the front element and the edge of the conical reflecting body.

On the basis of this recognition the invention, i.e. a lamp having a reflector envelope, was created which ensures modified light output, is equipped with a front element which is free of the drawback characterizing the state of the art, can be made with material savings, and during the life period determined by the insert lamp works reliably in both optical and mechanical respects.

Hence, the present invention relates to a reflector lamp of modified light output, which is equipped with a conical reflecting body carrying in a given case a thin dichroic or metallic layer and made preferably of pressed glass, with a light emitting insert lamp, preferably a halogen incandescent lamp and a front element fixed to the conical body. In accordance with the present invention a clearance is made between the conical body and the front element for fixation, the clearance being determined by the dimensions and the inner spring force of a mechanical fixing element, and at least partly filled with a deformable sealing material.

The mechanical fixing element is preferably a disc made of an elastic material equipped with at least three curved ears arranged along its periphery and made with an opening cut out in its central part.

The ears of the mechanical fixing element are advantageously equipped with at least one cam, or rather with at least one lug.

The deformable sealing material consists preferably of Teflon or silicone rubber or a thermoresistive adhesive.

BRIEF DESCRIPTION OF THE DRAWINGS

The invention will further be described on the basis of some preferred embodiments shown by way of example with reference to the accompanying drawings. In the drawings

DETAILED DESCRIPTION OF THE INVENTION AND PREFERRED EMBODIMENTS

Figure 1:
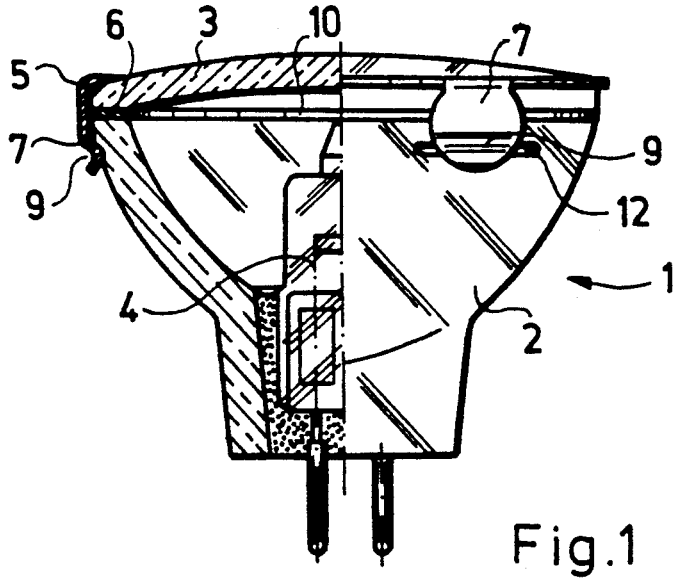
FIG. 1 illustrates in partial cross section a lamp with a reflecting body having a flat front surface.
Figure 2:
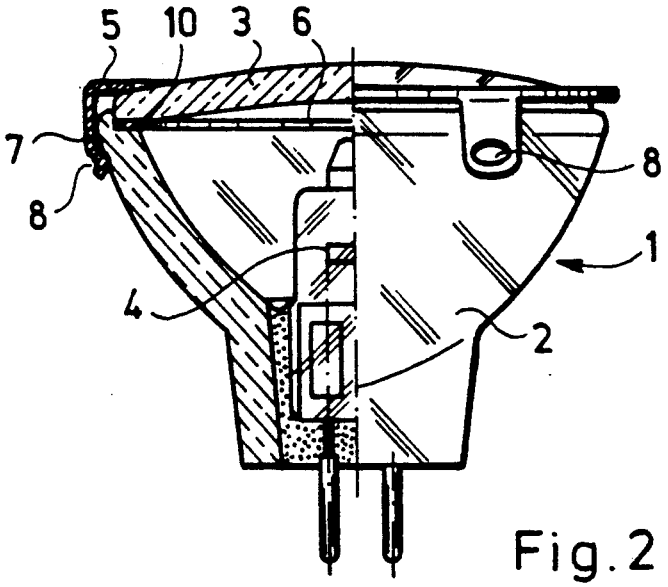
FIG. 2 illustrates in partial cross section a lamp with a conical reflecting body having a front surface with an edge.

The invention proposes a novel construction of a reflector lamp 1 shown in FIGS. 1 and 2, comprising a conical reflecting body 2 made of glass and carrying, if necessary, on its inner surface a dichroic or metallic layer for determining and in a given case for modifying the spectral composition of the light emitted by the reflector lamp 1. The inner surface of the conical reflecting body 2 is shaped according to the known principles, e.g. as a paraboloid having an opening closed by a front element 3. At the closed end of the conical reflecting body an insert lamp 4 is arranged.

The front element 3 is connected with the conical reflecting body 2 by means of a fixing element 5 and either a sealing material 6 or an adhesive filling at least partly a clearance 10 ensured between the front element 3 and the conical reflecting body 2.

The fixing element 5 is equipped with at least one ear 7 equipped with at least one cam 9 (FIGS. 1 and 3) or with at least one lug 8 (FIG. 2) matching by their inner surface corresponding intrusions 12 made in the outer surface of the conical reflecting body 2.

Figure 3:
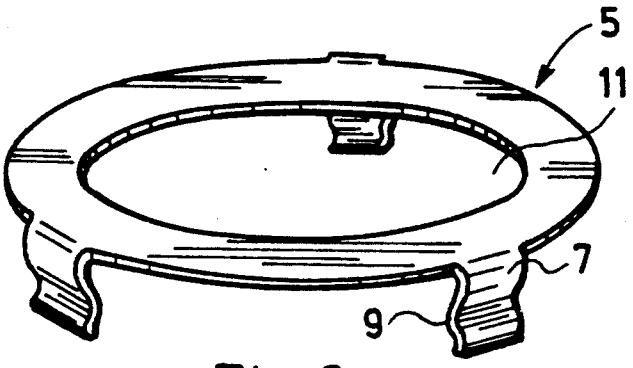
FIG. 3 shows an advantagoues embodiment of the fixing element constituted by a pressing disc.

The fixing element 5 ensures a mechanical pressure uniting the front element 3 with the conical reflecting body 2 (FIG. 3). The upper part of the fixing element 5 is a ring with a central opening 11 wherein the width of the ring is selected so that the fixing element 5 does not block the light output of the reflector lamp to significant extent.

For preparing the reflector lamp 1 in the first step in the narrow end of the conical reflecting body 2 made of pressed glass the insert lamp 4, which is generally a halogen incandescent lamp, is fixed. FIGS. 1 and 2 show such lamps. Thereafter the deformable sealing material 6 or adhesive is either pasted to or placed on the front surface of the conical body 2 or in a recess constituted by the edge of the conical reflecting body 2 and the front element 3. The thickness of the annular layer of the deformable sealing material is determined by both the shape and the inner spring force of the fixing element 5. This should be of the form such that the fixing element 5 is able to exert pressure through the front element 3 on the deformable sealing material 6. In this way the minimum and maximum value of the cross section of the clearance 10 can be reliably adjusted in dependency on the inner spring force of the fixing element 5. At the same time the tolerances are very small in the case of a predetermined fixing element 5, for example, the unsteadiness can be about $\pm 0.05$ mm$^2$ in the case of lamps of the same type.

After arranging the sealing element 6, the front element 3 is placed on the conical body 2 and the fixing element 5 is pressed on the assemblage ensuring limited axial movement of the front element relative to the conical body.

The modulus of elasticity of the fixing element 5 is preferably about $2.8.10^7$N/mm$^2$. Generally an element made of steel and having a thickness of about 0.15 mm is applied, wherein the width is determined by the fact that it should screen the light emitted by the insert lamp 4 in the possible less extent, but it should be wide enough to be reliably supported on the front element 3. The length of the ears 7 is determined from one side by the thickness of the front element 3 and from the other side by the fact that they should securely retain the conical body 2. This is ensured by the cams 9 in the case of the lamps shown in FIGS. 1 and 3 and by a lug 8 in the case of the embodiment shown in FIG. 2.

An example will be described to illustrate the invention in yet more detail, but without any restriction.

EXAMPLE

Reflector lamp for illuminating shop-windows

The insert lamp 4 is a 12 V, 50 W halogen incandescent lamp having a life period of about 3000 hours, which is characteristic for lamps used to illuminate shop windows.

The conical body 2 is made of pressed glass and is not equipped with any thin layer. Its greatest diameter amounts to about 5 cm; the front surface has an edge. The front element 3 is a lens made of pressed glass which directs accordingly the light emitted by the insert lamp 4. Its diameter is about 4.7 cm, the thickness is depending on the height of the edge of the conical reflecting body 2, about 1 mm, and it is slightly convexed. A similar lamp 1 is shown in FIG. 2.

Between the front element 3 and the conical reflecting body 2 the sealing material 6 is arranged in the form of a silicone ring having a cross-sectional area of about 1.1 mm$^2$.

The fixing element 5 is a steel disc having an opening 11 cut out in the central part and equipped with eyed ears 7 arranged equidistantly along the outer periphery. The outer diameter of the disc is about 5 cm, the inner diameter, that is, the diameter of the inner opening 11, is about 4.2 cm and its thickness is about 0.15 mm. The force of deformation exerted by the fixing element 5 is about 0.5N.

The mentioned force determines a clearance 10 of about 1.09 mm thickness between the conical body 2 and the front element 3. Because the diameter of the sealing material 6, i.e. the silicone ring, is 1.1 mm, it is by about 0.01 mm thicker than the thickness of the clearance 10 adjusted. This difference is equalized by the deformation of the silicone rubber.

The lamp for illuminating shop-windows remained as a complete unit during the whole life period. Upwardly and a in horizontal position 10—10 trial lamps were burned and in no case did displacement of the front element 3 with regard to the conical reflecting body 2 occur.

The lamp realized according to the present invention is especially advantageous in the case when the thermal expansion coefficients differ marketly for the materials of the conical reflecting body and the front element. In this case the adhesive bond of the conventional lamp with high probability will lose its ability to hold the assembly together before the end of the life period of the insert lamp and this must be avoided.

What we claim is:

1. A lamp with a reflector envelope, comprising a conical reflecting body, said conical reflecting body having an axis and an outer surface with spaced surface deformations, an insert light source arranged within said conical reflecting body along said axis and a front element fixed to said conical reflecting body, by means of a mechanical fixing body wherein between said conical reflecting body and said front element there is a clearance determined by the dimensions and the inner spring force of said fixing body, and at least a part of said clearance is occupied by a deformable sealing material, said fixing body comprising an annular ring made of elastic material and having a plurality of curved fixing ears distributed at equal angles along a periphery of said ring, and said plurality of curved fixing ears cooperate with at least some of said spaced surface deformations of said conical body outer surface to prevent movement and ensures fixing and limiting axial and lateral movement of said front element relative to said axis of said reflecting body.

2. The lamp according to claim 1, wherein said ears are equipped with at least one cam or lug.

3. The lamp according to claim 1, wherein said sealing material in said clearance is made of teflon or silicone rubber.

4. The lamp according claim 1, wherein said sealing material is a thermoresistent adhesive.

5. A lamp with a reflector envelope, comprising a conical reflecting body made of pressed glass and covered on its inner surface with a dichroic or metallic layer, said conical body of pressed glass having an axis and an outer surface with spaced surface deformations an insert light source made in the form of a halogen incandescent lamp arranged within said conical reflecting body and a light transmitting front element constituting a lens-shaped member made of glass fixed to said conical reflecting body by means of a mechanical fixing body, wherein between said conical reflecting body and said front element there is a clearance determined by the dimensions and the inner spring force of said fixing body, and at least a part of said clearance is occupied by a deformable sealing material, said fixing body comprising an annular ring made of elastic material and having a plurality of curved fixing ears distributed at equal angles along a periphery of said ring, and said plurality of curved fixing ears cooperate with at least some of said spaced surface deformations of said conical body outer surface to prevent movement and ensures fixing and limiting axial and lateral movement of said front element relative to said axis of said reflecting body.

6. A lamp with a reflector envelope, comprising a conical reflecting body, said conical reflecting body having an axis and an outer surface with spaced surface deformations, an insert light source arranged within said conical reflecting body, a front element fixed to said conical reflecting body, means for clamping said front element to said conical reflecting body with a clearance therebetween, and a layer of deformable sealing material located in said clearance, wherein said clamping means comprise a plurality of spring-like elements and means for interconnecting said spring-like elements in a peripherally distributed array, and said plurality of spring-like elements cooperate with at least some of said spaced surface deformations of said conical body outer surface to prevent movement and ensures fixing and limiting axial and lateral movement of said front element relative to said axis of said reflecting body.

* * * * *